US010529230B2

(12) United States Patent
Hofman

(10) Patent No.: US 10,529,230 B2
(45) **Date of Patent: *Jan. 7, 2020**

(54) METHOD FOR TRAFFIC CONTROL

(71) Applicant: Ofer Hofman, Timrat (IL)

(72) Inventor: Ofer Hofman, Timrat (IL)

( * ) Notice: Subject to any disclaimer, the term of this patent is extended or adjusted under 35 U.S.C. 154(b) by 0 days.

This patent is subject to a terminal disclaimer.

(21) Appl. No.: 16/152,500

(22) Filed: Oct. 5, 2018

(65) Prior Publication Data

US 2019/0043349 A1 Feb. 7, 2019

Related U.S. Application Data

(63) Continuation-in-part of application No. 15/240,366, filed on Aug. 18, 2016, now Pat. No. 10,121,369.

(60) Provisional application No. 62/215,320, filed on Sep. 8, 2015.

(51) Int. Cl.

| | |
|---|---|
| ***G08G 1/07*** | (2006.01) |
| ***G08G 1/08*** | (2006.01) |
| ***G08G 1/01*** | (2006.01) |
| ***G08G 1/081*** | (2006.01) |

(52) U.S. Cl.

CPC ..... *G08G 1/08* (2013.01); *G08G 1/0116* (2013.01); *G08G 1/0145* (2013.01); *G08G 1/081* (2013.01)

(58) Field of Classification Search

CPC ..... G08G 1/083; G08G 1/0145
USPC ..... 340/910
See application file for complete search history.

(56) References Cited

U.S. PATENT DOCUMENTS

2003/0210156 A1* 11/2003 Nishimura ..... G08G 1/08 340/907
2004/0012487 A1 1/2004 Burns et al.
2009/0040069 A1* 2/2009 Afzulpurkar ..... G06K 9/00785 340/934
2010/0171640 A1* 7/2010 Delia ..... G08G 1/07 340/907
2010/0321210 A1* 12/2010 Lee ..... G08G 1/081 340/917
2014/0139358 A1* 5/2014 Lee ..... G08G 1/07 340/907
2015/0321684 A1* 11/2015 Lehnertz ..... B61L 29/22 246/477
2016/0027299 A1* 1/2016 Raamot ..... G08G 1/08 340/917
2016/0275789 A1* 9/2016 Pencheon ..... G08G 1/0116

FOREIGN PATENT DOCUMENTS

KR 1020090008964 A 1/2009

* cited by examiner

*Primary Examiner* — Tanmay K Shah
(74) *Attorney, Agent, or Firm* — Manelli Selter PLLC; Edward Stemberger

(57) ABSTRACT

Described is an algorithm to optimize traffic light activity and minimize traffic congestion. Traffic conditions are monitored by sensors and the algorithm dynamically controls the green light time to account for traffic conditions and enhance the traffic flow. In one example, the green light time of each lane is reduced or increased according to traffic flow in the lane.

12 Claims, 4 Drawing Sheets

METHOD FOR TRAFFIC CONTROL

TECHNOLOGY FIELD

The present method relates to the field of traffic control and in particular to dynamic algorithms for determining traffic lights sequences to reduce traffic congestion.

BACKGROUND

Traffic light control is the most important and efficient method for controlling traffic in urban areas. There are three categories of traffic light control strategies: fixed-time control, traffic actuated control and traffic adaptive control. In fixed time control each traffic light has a predefined duration for allowing traffic to flow. The controller cycles between all the traffic signals. In this manner each lane gets a predefined duration of a green light and flow of traffic. The predefined green light duration is determined by the system designer based on expected traffic flow; relative road size; time of day; and other considerations. As the rate of flow of traffic increases, the fixed time control may not provide the optimal division of time between the different lanes and traffic congestion may arise.

A remedy to the inefficiencies of fixed time traffic light control is to measure the traffic flow and change the traffic light duration according to measured traffic flow. Examples of measuring traffic flow include; wire loops embedded in the road which generates a current when a car passes over them; pressure sensitive devices embedded in the road; acoustic devices to measure traffic flow; and image based systems to measure traffic flow. Examples of existing algorithms are given in Ref [CYBERNETICS AND INFORMATION TECHNOLOGIES, Volume 13, No 3 DOI: 10.2478/cait-2013-0029] and Ref[Self-Algorithm Traffic Light Controllers for Heavily Congested Urban Route, WSEAS TRANSACTIONS on CIRCUITS and SYSTEMS, Issue 4, Volume 11, April 2012.

Existing solutions focus on the static measure of traffic. For example, a green traffic light is provided if the traffic sensor indicates the existence of a car in the relevant lane. To assess the amount of traffic in the lane these solutions require additional sensors which increases the cost of deployment and significantly increases the cost of operation. The required computing resources for some algorithms are not supported by existing traffic light controllers, so a deployment of some systems requires an overhaul of the existing infrastructure. Furthermore, the cited examples which dynamically change the traffic light duration based on static measurements also change the cycle of the traffic signal. Changing the cycle of the traffic light disrupts the flow of traffic and induces congestion across the road system. In some examples of state of art solutions, the applied methods can only reduce the preplanned maximum time for each light. In one example, if 20 seconds are allocated for a green light than the state of art method will reduce the allocated time from 20 seconds to a smaller number. Hence this will shorten the allocated green time to a specific lane, without an increase in green light time to other lanes. The inability to increase the allocated green light time to more than 20 seconds results in traffic congestion as demonstrated in this example. Assuming traffic is congested and requires 23 seconds to pass through the junction. If only 20 seconds are allocated than the remaining 3 seconds of traffic would be stopped for next green light cycle. In the next green light cycle, there will now be 23 seconds of traffic plus the 3 seconds from the previous cycle. Thus the traffic flow is impeded and congestion arises rapidly.

Hence an alternative algorithm is required. The desired algorithm should provide the following features:

Can be implemented in the existing infrastructure of controllers and single sensor per lane.

Maintains the traffic flow cycle to prevent disruption to traffic.

In some examples, the proposed algorithm can also increase the allocated green time beyond the static allocated green time.

DESCRIPTION

Figure 1:
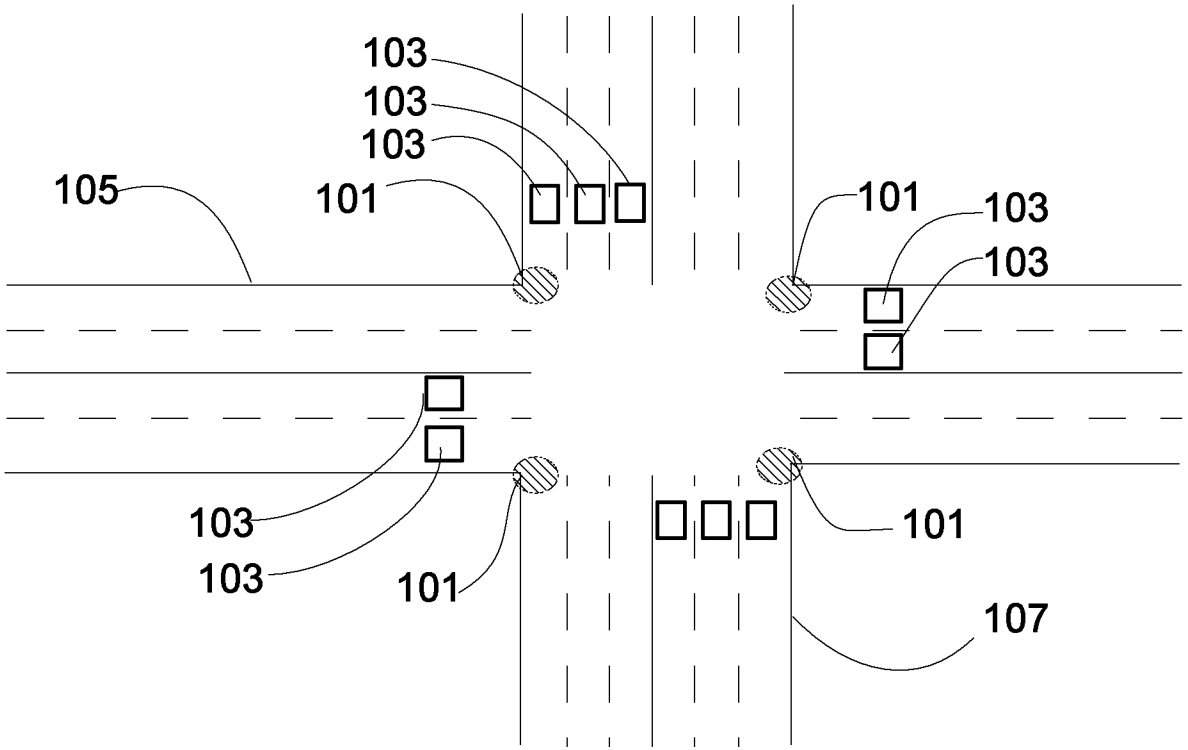
FIG. 1 is an example of a road intersection with traffic signals and lane sensors.

This document describes an algorithm, method and device for optimizing traffic light duration in a desired direction/lane and which overcomes the deficiencies of existing algorithms. FIG. 1 is an example of a traffic intersection. The intersection is the area where two or more roads intersect. Road (105) and road (107) are examples of roads which intersect. In one example the traffic flow through the intersection is controlled by traffic lights (101). The traffic light (101) directs the traffic through the use of pre-designated signals such as light colors, or light shape. The traffic light (101) lighting pattern is designed so that at any given time, the traffic emanating from one lane would not intersect with traffic emanating from another lane. In a further example, traffic sensors (103) register the passage of an automobile over the sensor. Examples of traffic sensors (103) include; induction loops which generate current when a metal body such as an automobile passes over the sensor; Pressure or shear sensors which measure the weight of deformation caused by the passage of an automobile; Acoustic sensors which sense the passage of an automobile; Or image sensors which record and analyze the flow of traffic.

Figure 2:
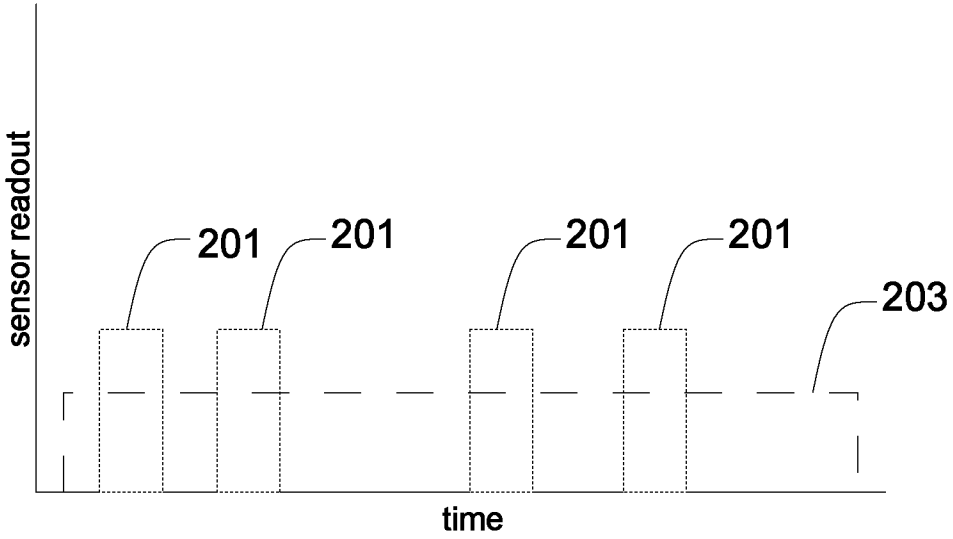
FIG. 2 is an example of a graph of sensor signal over time.

FIG. 2 is an example of a graph of sensor signal over time. The "x" axis depicts the time, while the "y" axis depicts the sensor signal. In one example, when an automobile traverses the sensor, the sensor will emit a signal event (201) which corresponds to the time of traversal. The period of a green signal, the green light time (203) is depicted as a dashed line. During the time the traffic light is green, several cars may traverse the sensor, hence FIG. 2 depicts several signal events (201), each signal event (201) corresponding to one automobile traversing the sensor. The "usage time" is defined as the sum of all signal events (201) in a lane. The "usage percentage" is defined as the "usage time" divided by the green light time (203).

Figure 3:
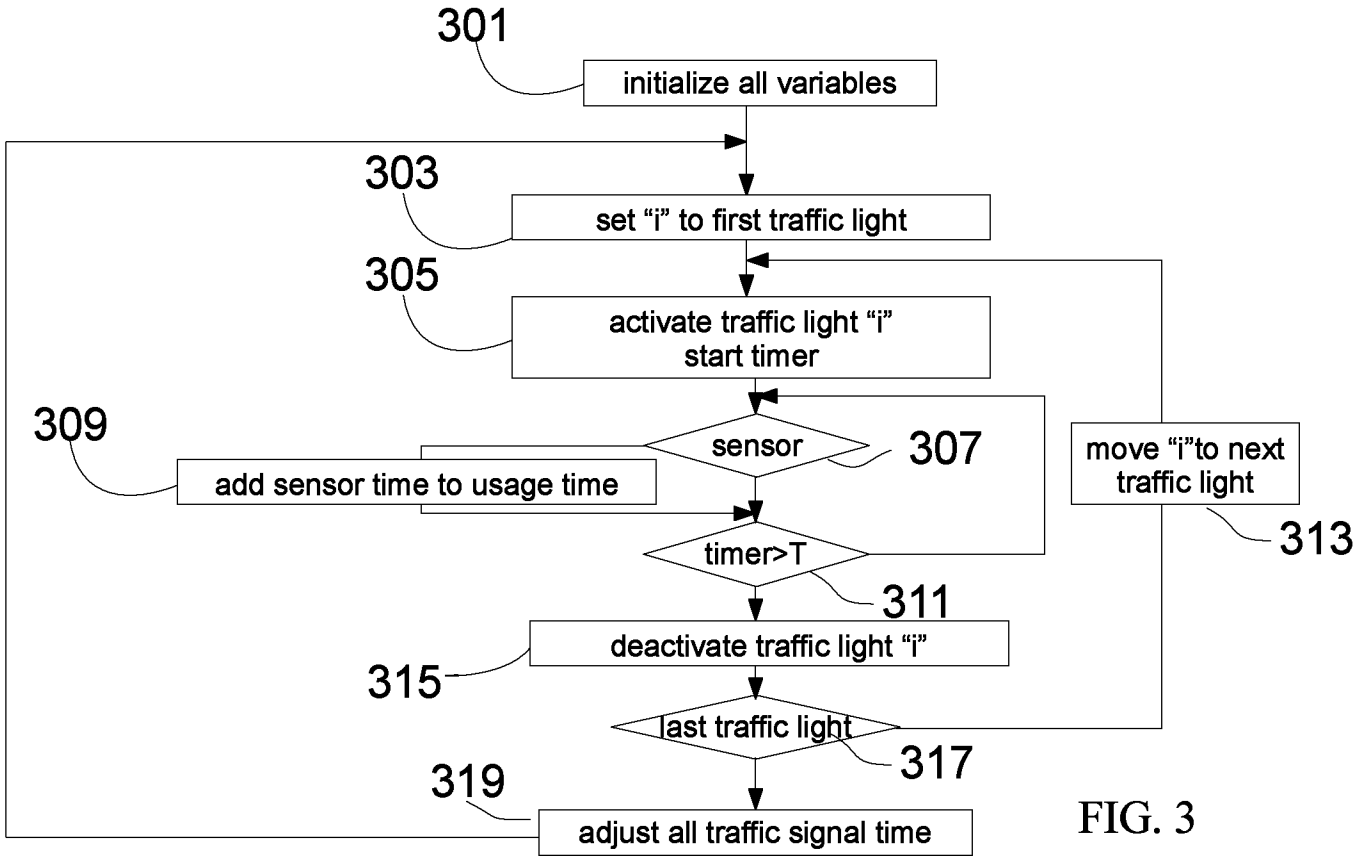
FIG. 3 is an example of an algorithm for optimizing traffic light duration.

FIG. 3 is an example of an algorithm for optimizing the traffic flow and which does not suffer from the deficiencies of state of art algorithms. Block (301) of the algorithm initializes all the variables required for the algorithm. Examples of variables include; a counter for the traffic lights (e.g. "i"); a timer; a green light time (203 in FIG. 2) for each traffic light. Block (303) sets the traffic light counter (e.g. "i") to the first traffic light. This facilitates the main loop to start the traffic light cycle. Block (305) activates the designated traffic light (e.g. traffic light "i"). In one example, the activation is composed of a sequence of lights leading from a red light to a green light. In addition block (305) starts a timer. The timer is used to limit the green light in the traffic light to the green light time (203 in FIG. 2). Block (307) measures the traffic through the sensor which is relevant for the designated traffic light (e.g. traffic light "i"). If the sensor measurement is positive then block (309) adds the time the sensor is positive to the usage time. If the sensor measurement is zero, then no time is added to the usage time. Block (311) compares the timer time to the green light time (203 in FIG. 2) of the designated traffic light (e.g. traffic light "i"). If the elapsed time is shorter than the green light time (203 in FIG. 2), block (307) is executed and the sensor is measured. If the elapsed time is greater than the green light time (203 in FIG. 2) the designated traffic light (e.g. traffic light "i") is deactivated (block 315). In one example, the deactivation is a sequence of light signals starting with green light and ending with a red light. Block (317) checks if the active traffic light is the last of the traffic lights. If the active traffic light is not the last, the traffic light counter (e.g. "i") is changed to reflect the next designated traffic light (e.g. traffic light "i+1") (block 313). The algorithm then executes the loop again for the next designated traffic light (e.g. traffic light "i+1"). If the active traffic light is the last traffic light in the sequence than block (319) is executed and the green light time (203 in FIG. 2) duration for each traffic light, is amended based on the usage time measurements.

In one example the usage time is changed by the following procedure. For the traffic light with the maximum usage percentage increase the green light time (203 in FIG. 2) by one unit. If there is more than one traffic light with the same usage percentage as the maximum usage percentage, than randomly choose one of the traffic lights with the maximum usage percentage. For the traffic light with the minimum usage percentage decrease the green light time (203 in FIG. 2) by one unit. If there is more than one traffic light with the same usage percentage as the minimum usage percentage, than randomly choose one of the traffic lights with the minimum usage percentage. The above described procedure ensures that the total green light time of all the traffic lights is constant, which maintains traffic flow across multiple intersections. One example of a time unit is one second. Another example of a time unit is 5 seconds.

In an additional example the usage time is changed by the following procedure. If the total duration of all green light is smaller than a predefined maximum total green light time than for the traffic light with the maximum usage percentage increase the green light time (203 in FIG. 2) by one unit. If there is more than one traffic light with the same usage percentage as the maximum usage percentage, than randomly choose one of the traffic lights with the maximum usage percentage. If the total duration of all green light is larger than a predefined minimum total green light time than for the traffic light with the minimum usage percentage decrease the green light time (203 in FIG. 2) by one unit. If there is more than one traffic light with the same usage percentage as the minimum usage percentage, than randomly choose one of the traffic lights with the minimum usage percentage. The above described procedure ensures that the total green light time of all the traffic lights is kept within the bounds defined by minimum total green light time and maximum green light time. One example of a time unit is one second. Another example of a time unit is 2 seconds. One example of minimum total green light is 40 seconds. An example of maximum green light time is 120 seconds.

Hence one example is a method for controlling traffic signals comprising of; a green light time for each traffic light; measuring usage percentage for each traffic light; increasing the green light time of the traffic light with maximum usage percentage; and reducing the green light time of the traffic light with minimum usage percentage. In another example above method is continuously repeated. In another example the increase in green light time is a fixed duration. In a further example the fixed duration is one second. In an alternative example the fixed duration is between one second to five seconds. In another example the reduction in green light time is a fixed duration. In an additional example the increase and reduction in green light time are equal and of a fixed duration. Another example is a method for controlling traffic signals comprising of; a total green light time; a maximal total green light time; a minimal total green light time; a green light time for each traffic light; measuring usage percentage for each traffic light; if the total green light time is smaller than the maximal green light time than increasing the green light time of the traffic light with maximum usage percentage; and if the total green light time is smaller than the maximal green light time than reducing the green light time of the traffic light with minimum usage percentage. In another example the method is continuously repeated. In another example the increase in green light time is a fixed duration. In another example the reduction in green light time is a fixed duration. In an additional example the increase and reduction in green light time are equal and of a fixed duration. In these examples a change in the green light time in one direction changes the ratio of green light time between the lanes. In an alternative example the increase; decrease or both increase and decrease duration is any of but not limited to; fixed; one of a fixed set of numbers; continuous within a defined range. In a further example the duration is one of a fixed set of numbers and determined by the ratio of the usage percentages. In one example if the maximal usage percentage difference is greater than a first threshold, the duration is 3 sec and if the maximal usage percentage difference is smaller than a second threshold the duration is 1 sec and if smaller than a third threshold the duration is 0, i.e. there is no change in green light time. In a further example the first threshold is any of but not limited to; 10%; 20%; 30; 40%; 50%; 60%; the second threshold is any of but not limited to; 10%; 20%; 30; the third threshold is any of but not limited to; smaller than 10%; smaller than 20%.

In another example the traffic sensor is adapted to provide traffic usage. State of art traffic sensors provide an indication of traffic presence. For example an induction sensor will provide an electrical signal when a vehicle is above the induction loop. In this example, a timer or clock is added to the readout electronics and the electrical output provides an indication of the ratio of the time that vehicles where present above the induction loop to the time that no vehicle was above the induction loop. In additional examples the inductor loop sensor can be replaced with any of; video sensor; acoustic sensor; pressure sensor; vibration sensor. In another example the electronic output is generated by an analog electronic circuit. In one example the output of the induction loop reading is connected to a capacitor and the output increases over time. A clock periodically samples the capacitor and resets the capacitor voltage. The sample output is the required traffic usage signal. In another example the electronic output can be implemented using a digital electronic circuit. The digital electronic circuit receives the sampled output of the induction loop sensor and the timer or clock signal and calculates the ratio of time the vehicles are over the induction loop compared to the time the sensors are not over the induction loop.

In another example the device for measuring traffic usage comprising of; a traffic sensor; wherein said sensor provides a signal when a vehicle is present in the vicinity of the sensor; a timer device; wherein said timer device provides an electrical signal at a fixed interval; and wherein the output signal of the device is proportional to the duration that a vehicle was present in the vicinity of the traffic sensor to the duration that no vehicle was present in the vicinity of the sensor. In a further example the device output is an analog signal. In a further example the device output is a digital signal.

In another example the method for controlling traffic signals comprises of; a total green light time; a maximal total green light time; a minimal total green light time; a green light time for each traffic light; measuring usage percentage for each traffic light; if the total green light time is smaller than the maximal green light time than increasing the green light time of the traffic light with maximum usage percentage; and if the total green light time is larger than the minimal green light time than reducing the green light time of the traffic light with minimum usage percentage.

The algorithm balances the usage for each green light by passing time units from the minimum used direction to the maximum used direction. The algorithm changes only the green light duration plan of a traffic light junction, and does not change any other aspect of the junction control, thus do not impair safety of passengers in the junction. Common Traffic Light Junctions have one or more predefined green light duration plan which can change according to the time of the day. This algorithm manages and changes the plan continuously to find the plan that optimizes the traffic flow for any predefined green light duration.

In one further example, the algorithm is activated when the traffic duration sensed by a sensor divided by the total traffic duration or green light time is greater than a defined threshold. In one example if the time of detected cars by a sensor divided by total green light is greater than any of but not limited to 10%; 20%; 25% 50%, the algorithm is activated and the traffic flow is controlled as defined in the algorithm above. In an alternative example if in any traffic lane the traffic usage is greater than a defined threshold the algorithm is activated.

In a further example when the traffic duration sensed by a sensor divided by the total traffic time is smaller than a defined threshold for all sensors, the algorithm deactivates gradually. In the deactivated state the green light time is predefined by the system designer based on expected traffic flow; relative road size; time of day; and other considerations as used in state of art system design. During the deactivation procedure, the green light time of each traffic light is reduced or increased by one unit until it conforms to the predefined green light time. In one example at every cycle, the algorithm reduces the largest traffic light usage time by one unit until it reaches its predefined value; and increases the smallest traffic light usage time by one unit until it reaches its predefined value. In a further example at every cycle and for every traffic light the algorithm calculates the difference between the current green light time and the predefined green light time. If the difference is greater than zero, i.e. the current green light time is larger than the predefined green light time, the current green light time is reduced by one unit; if the difference is smaller than zero, the current green light time is increased by one unit. In one example if the traffic duration detected by a sensor divided by the total traffic duration detected by all sensors or green light time is smaller than any of but not limited to 40%; 30%; 25% the maximum traffic light usage time is reduced by one unit and the minimum traffic light usage time is increased by one unit.

In a further example the algorithm includes a module to detect a car stuck in the intersection. The module detects a high count from the sensor as the car is stuck on the sensor causing a continuous reading. Hence if the algorithm detects a very high lane usage, it implements a one shot. The one shot algorithm resets the sensor reading after a set time corresponding to a standard car transition over the detector. For example, the standard time of transition is 2 seconds. After 3 seconds the sensor is reset. If the car is stuck on the sensor, the sensor reading is constant, the sensor output is reset to zero and the algorithm accounts for the stuck car by accumulating zero traffic. Hence if the algorithm detects a car is stuck, the lane is marked as no car until it detects the car has moved and then continues normal operation.

In a further example the algorithm includes a multiple lane using same traffic light module. The multiple lane using same traffic light module measures the number of cars per lane with a sensor embedded in each lane; combines the number of cars in all lanes and uses the combined number of cars in the algorithm as described above When multiple lanes exist for a particular direction, but controlled with a single traffic light, the algorithm chooses the lane with the highest usage percentage as the traffic usage for the direction. When multiple lanes exist for a particular direction, but controlled with more than one traffic light, each lane is treated independently. In another example, traffic lanes are grouped together if they can be operated simultaneously. In one example left turning lines of opposite directions are grouped together. The lane with the highest usage percentage is used as the traffic usage indicator.

In a further example if the sensor reading is inconsistent or erroneous the algorithm is not activated. In a further example, in case of an erroneous sensor, an alert is provided to the central traffic control. One example of an erroneous sensor is a sensor providing a constant reading without any change. An alternative example of a sensor providing an erroneous reading is a sensor alternating between 1 and 0 faster than the time it takes for a car to pass over the sensor. For example if the standard time for a car passing over the sensor is 2 seconds, a sensor providing an alternating reading for multiple readings at a rate of higher than 1 Hz will be tagged as erroneous.

The above described method can be implemented in a traffic intersection. In one example a traffic intersection comprising; two or more intersecting roads; two or more traffic lights; a traffic light controller executing a method for controlling traffic signals comprising of; a green light time for each traffic light; measuring usage percentage for each traffic light; increasing the green light time of the traffic light with maximum usage percentage; and reducing the green light time of the traffic light with minimum usage percentage. In a further example the method for controlling traffic signals is continuously repeated. In a further example the increase in green light time is a fixed duration. In a further example the reduction in green light time is a fixed duration. In a further example the increase and reduction in green light time are equal and of a fixed duration.

To sum, a method is disclosed for controlling traffic signals which includes; a green light time for each traffic light; measuring usage percentage for each traffic light; if the maximal usage percentage difference is larger than an activation threshold; increase the green light time of the traffic light with maximum usage percentage; and decrease the green light time of the traffic light with minimum usage percentage; if the maximal usage percentage difference is smaller than a deactivation threshold; gradually adjust the green light time to conform to the predefined green light time; wherein the method is continuously repeated. In a further example increasing the green light time is conducted with a fixed duration. In a further example decreasing the green light time is conducted with a fixed duration. In a further example increasing or reducing the green light time is conducted with equal and fixed duration. In an alternative example a method for controlling traffic signals including; a total green light time; a maximal total green light time; a minimal total green light time; a green light time for each traffic light; measuring usage percentage for each traffic light; if the maximal usage percentage difference is larger than an activation threshold; then if the total green light time is smaller than the maximal green light time than increasing the green light time of the traffic light with maximum usage percentage; or if the total green light time is larger than the minimal green light time than reducing the green light time of the traffic light with minimum usage percentage; if the maximal usage percentage difference is smaller than a deactivation threshold; gradually adjust the green light time to conform to the predefined green light time; and wherein the method is continuously repeated. In a further example increasing the green light time is conducted with a fixed duration. In a further example decreasing the green light time is conducted with a fixed duration. In a further example increasing or reducing the green light time is conducted with equal and fixed duration. In an alternative example a traffic intersection which includes; two or more intersecting roads; two or more traffic lights; a traffic light controller executing a method for controlling traffic signals comprising of; a green light time for each traffic light; measuring usage percentage for each traffic light; if the maximal usage percentage difference is larger than an activation threshold; increasing increase the green light time of the traffic light with maximum usage percentage; and reducing decrease the green light time of the traffic light with minimum usage percentage; if the maximal usage percentage difference is smaller than a deactivation threshold; gradually adjust the green light time to conform to the predefined green light time; and wherein the method for controlling traffic signals is continuously repeated. In a further example increasing the green light time is conducted with a fixed duration. In a further example decreasing the green light time is conducted with a fixed duration. In a further example increasing or reducing the green light time is conducted with equal and fixed duration.

The described algorithm expands on the state of art and resolves the deficiencies of existing solutions namely; the algorithm can be implemented in the existing infrastructure of controllers and single sensor per lane, and the algorithm maintains the traffic flow cycle to prevent disruption to traffic. It is clear that in the implementation of the apparatus and method, many modifications could be made to the system that carries out the described algorithm. It should be considered that all modifications and alterations of the system and algorithm are falling within the scope of this document.

Figure 4:
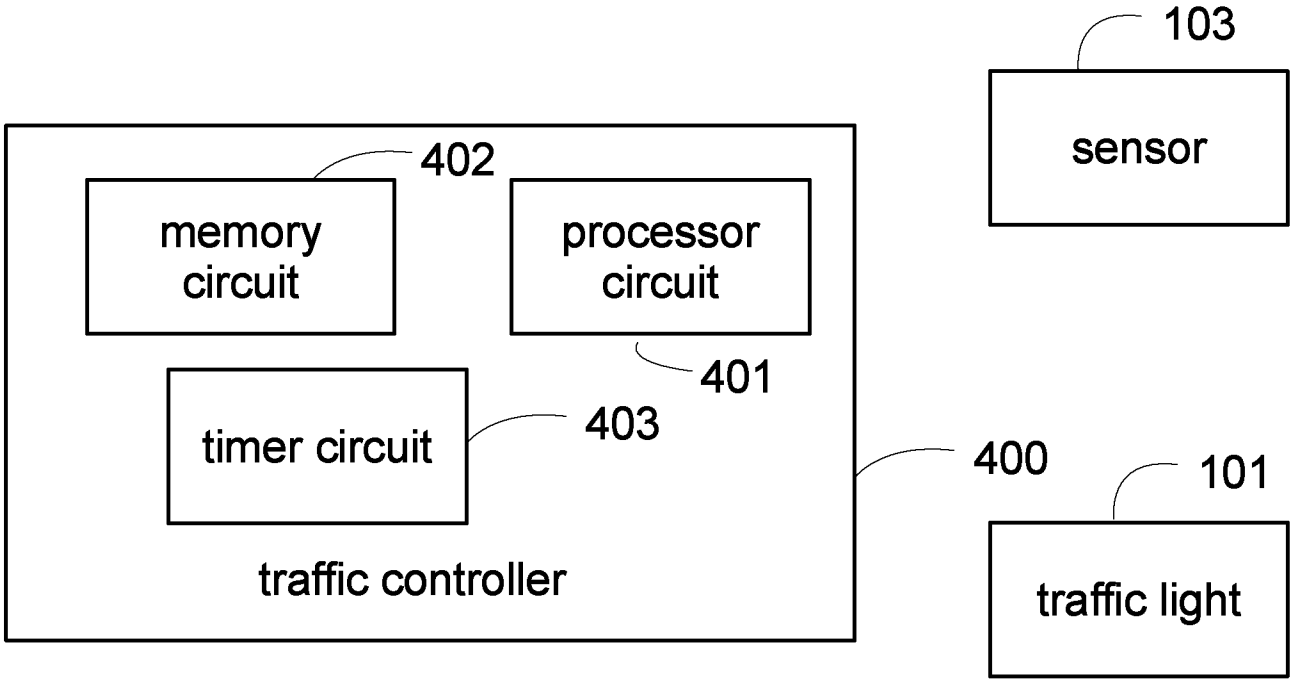
FIG. 4 is a block diagram of a circuit of the embodiment.

With reference to FIG. 4, the operations and algorithms described herein can be implemented as executable code within a micro-controller 400 or control device having processor circuit 401, or stored on a standalone computer or machine readable non-transitory tangible storage medium that are completed based on execution of the code by a processor circuit implemented using one or more integrated circuits. Example implementations of the disclosed circuits include hardware logic that is implemented in a logic array such as a programmable logic array (PLA), a field programmable gate array (FPGA), or by mask programming of integrated circuits such as an application-specific integrated circuit (ASIC). Any of these circuits also can be implemented using a software-based executable resource that is executed by a corresponding internal processor circuit such as a micro-processor circuit (not shown) and implemented using one or more integrated circuits, where execution of executable code stored in an internal memory circuit causes the integrated circuit(s) implementing the processor circuit to store application state variables in processor memory, creating an executable application resource (e.g., an application instance) that performs the operations of the circuit as described herein. Hence, use of the term "circuit" in this specification refers to both a hardware-based circuit implemented using one or more integrated circuits and that includes logic for performing the described operations, or a software-based circuit that includes a processor circuit (implemented using one or more integrated circuits), the processor circuit including a reserved portion of processor memory for storage of application state data and application variables that are modified by execution of the executable code by a processor circuit. A memory circuit 402 can be implemented, for example, using a non-volatile memory such as a programmable read only memory (PROM) or an EPROM, and/or a volatile memory such as a DRAM, etc. The micro-controller 400 can be considered to be part of the traffic light controller noted above that is operatively connected with the sensors 103 and the traffic lights 101.

What is claimed is:

1. A method for controlling traffic signals comprising:

a green light time for each traffic light;

measuring usage percentage for each traffic light;

if the maximal usage percentage difference is larger than an activation threshold;

increase the green light time of the traffic light with maximum usage percentage; and decrease the green light time of the traffic light with minimum usage percentage;

if the maximal usage percentage difference is smaller than a deactivation threshold; gradually adjust the green light time to conform to the predefined green light time; wherein the method is continuously repeated.

2. The method of claim 1, where increasing the green light time is conducted with a fixed duration.

3. The method of claim 1, where decreasing the green light time is conducted with a fixed duration.

4. The method of claim 1, where the increasing or reducing the green light time is conducted with equal and fixed duration.

5. A method for controlling traffic signals comprising:

a total green light time;

a maximal total green light time;

a minimal total green light time;

a green light time for each traffic light;

measuring usage percentage for each traffic light;

if the maximal usage percentage difference is larger than an activation threshold;

then if the total green light time is smaller than the maximal green light time than increasing the green light time of the traffic light with maximum usage percentage; or if the total green light time is larger than the minimal green light time than reducing the green light time of the traffic light with minimum usage percentage;

if the maximal usage percentage difference is smaller than a deactivation threshold;

gradually adjust the green light time to conform to the predefined green light time; and wherein the method is continuously repeated.

6. The method of claim 5, where increasing the green light time is conducted with a fixed duration.

7. The method of claim 5, where decreasing the green light time is conducted with a fixed duration.

8. The method of claim 5, where the increasing or reducing the green light time is conducted with equal and fixed duration.

9. A traffic intersection comprising:

two or more intersecting roads;

two or more traffic lights;

a traffic light controller executing a method for controlling traffic signals comprising of;

a green light time for each traffic light;

measuring usage percentage for each traffic light;

if the maximal usage percentage difference is larger than an activation threshold; increasing increase the green light time of the traffic light with maximum usage percentage; and reducing decrease the green light time of the traffic light with minimum usage percentage;

if the maximal usage percentage difference is smaller than a deactivation threshold; gradually adjust the green light time to conform to the predefined green light time; and wherein the method for controlling traffic signals is continuously repeated.

10. The method for controlling traffic signals of claim 9, where increasing the green light time is conducted with a fixed duration.

11. The method for controlling traffic signals of claim 9, where decreasing the green light time is conducted with a fixed duration.

12. The method for controlling traffic signals of claim 9, where the increasing or reducing the green light time is conducted with equal and fixed duration.

* * * * *